United States Patent [19]

Petrusek

[11] 4,030,736

[45] June 21, 1977

[54] MAGNETIC TARGET THROWING GAME

[76] Inventor: Victor Petrusek, 18511 Gottschalk Ave., Homewood, Ill. 60430

[22] Filed: Jan. 2, 1976

[21] Appl. No.: 646,161

[52] U.S. Cl. ..... 273/95 R; 273/102 R; 273/106 R; 46/22; 273/106 F

[51] Int. Cl.[2] ..... A63B 71/04; A63H 33/26

[58] Field of Search ..... 46/DIG. 1, 22; 273/95 R, 102 R, 105 R, 106 R, 102 B, 106 B, 106 F; 40/142 A; 35/7 A

[56] References Cited

UNITED STATES PATENTS

| | | | |
|---|---|---|---|
| 2,465,971 | 3/1949 | Leblang | 46/236 |
| 2,477,531 | 7/1949 | Volman | 273/106 R |
| 2,554,408 | 5/1951 | Hile | 46/DIG. 1 |
| 2,562,089 | 7/1951 | Fishlove | 273/106 R |
| 2,843,970 | 7/1958 | Keuls | 46/22 |
| 2,928,677 | 3/1960 | McAdam | 273/95 R |
| 3,026,110 | 3/1962 | Hess | 273/102 R |
| 3,573,869 | 4/1971 | Duckett | 273/95 R |

FOREIGN PATENTS OR APPLICATIONS

| | | | |
|---|---|---|---|
| 635,367 | 1/1962 | Canada | 273/106 R |

*Primary Examiner*—Richard C. Pinkham
*Assistant Examiner*—Lawrence Anderson
*Attorney, Agent, or Firm*—Sabin C. Bronson

[57] ABSTRACT

A magnetic target throwing game is provided in a package which forms part of the game. The package is a rectangular cardboard having its side edges folded over into a frame-like edge, joined together at the corners so that the back of the package presents a flat surface with a frame about the sides thereof. On the surface, within the frame is depicted the outline of a head, for example, or perhaps a spider web on which is shown a spider. Removable elements, which may be facial features, such as eyes, nose, mouth etc., or a fly, are provided, having a magnetic back piece to be thrown at and magnetically held on the head outline, or the spider web on the surface of the back of the package. The package is then enclosed in a transparent plastic sheet.

2 Claims, 4 Drawing Figures

MAGNETIC TARGET THROWING GAME cl BACKGROUND and SUMMARY

The present invention relates to games and particularly to a game requiring skill to play the game.

The game comprises a rectangular package having a semi-rigid flat back or bottom on which is delineated the outline of a face, for example, or any other object, such as a spider web. The backing is provided with a small hole in the center of the top of the frame, so that the package may be suspended from a hanger on a wall and used as the target in playing the game.

DESCRIPTION of the PREFERRED EMBODIMENTS

Figure 2:
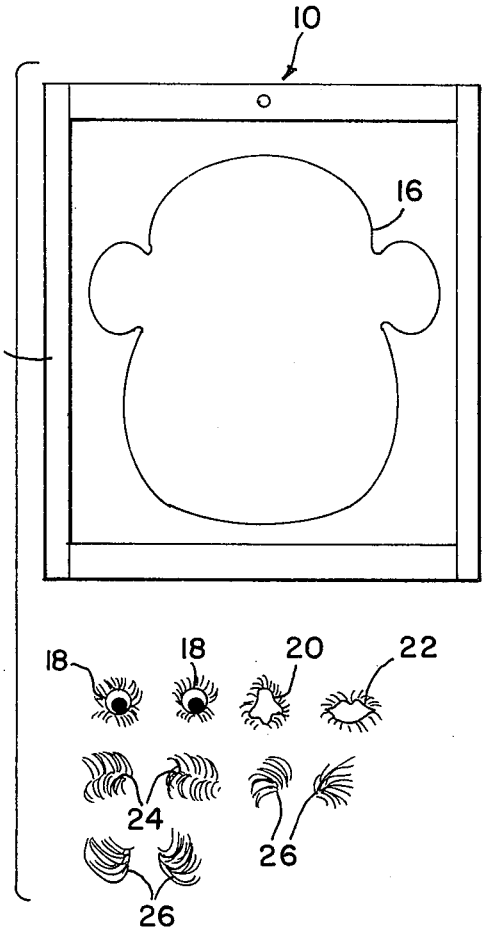
FIG. 2 is a plan view of the package with the facial features removed and shown separately at the bottom of FIG. 2.
Figure 3:
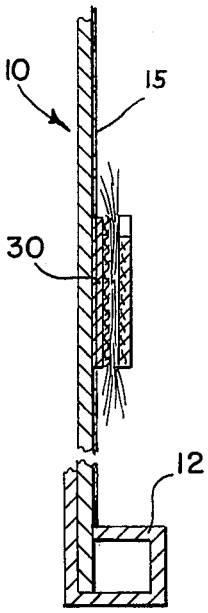
FIG. 3 is a section on the line 3—3 of FIG. 1.

Referring to the drawing, there is shown at 10 a rectangular flat package made from suitable rigid material such as paperboard, plastic or the like, the side margins of which are folded into a rectangular tube as shown at 12, FIG. 2, to form a frame about the back of the package, and give strength to the package. The center of the back of the package, adjacent the top thereof, is provided with a hole 14 so that the package may be suspended from a wall or vertical surface. The package thus has the appearance of a frame for a picture. Between the sides, the surface of the back of the package is faced with a sheet of ferrous metal 15 to which magnetic tabs will adhere.

Figure 4:
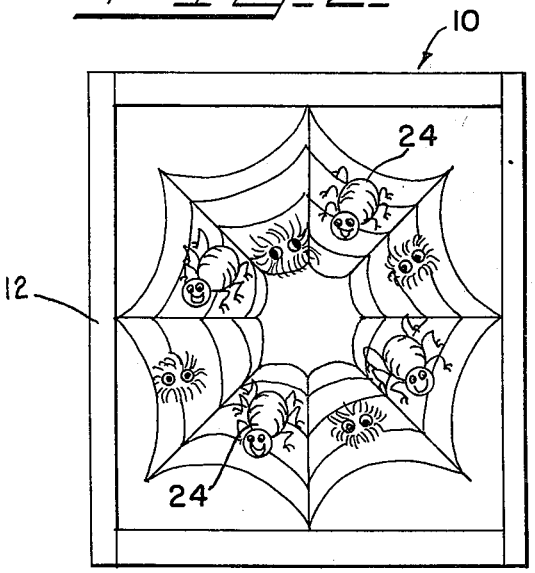
FIG. 4 is a plan view of the package with a representation of a spider web thereon, and removable spider and fly feature elements thereon.

On the face or sight of the package is delineated an outline 16 of a head, for example, as shown in FIG. 2, or it may be of a spider web or other object as shown in FIG. 4.

The elements for completing a face to be formed on the outline 16 of a head, comprise dart-like tabs 18—18, which simulate eyes; a tab 20 which simulates a nose; a tab 22 which simulates a mouth; or tabs 24—24 which simulate bugs, and 26—26 which simulate tufts of hair, or the like.

The tabs are each made from a piece of magnetized material 30 which will attach itself to a ferrous metal surface upon contact therewith. The various face elements may be painted, printed or otherwise formed on one surface of each tab, and, as shown, threads or animal hair may be used about the margin of the element to simulate the particular face element of the tab.

Figure 1:
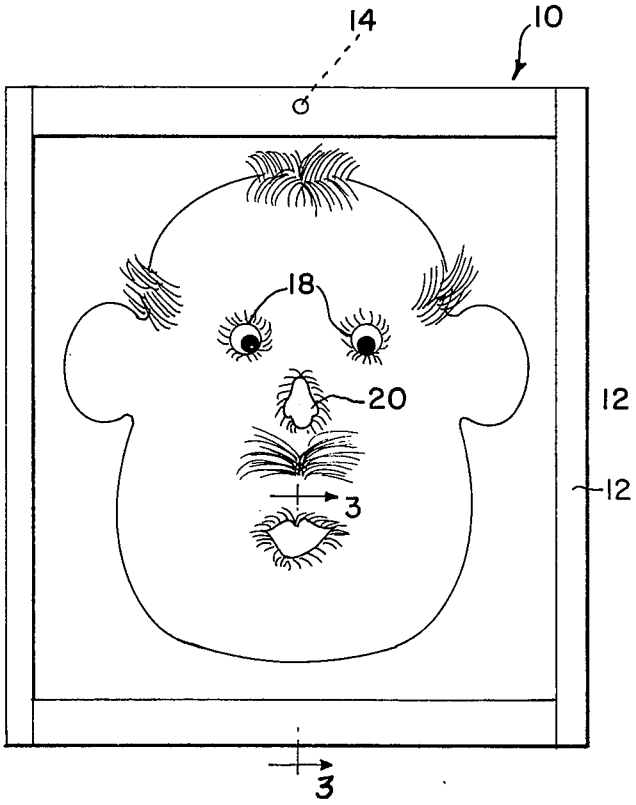
FIG. 1. is a plan view of the magnetic target throwing game package.

The game is played by suspending the package 10 on a wall or other suitable surface to be used as a target against which the various tabs are to be thrown. The object is to throw the respective elements at the blank outline as shown in FIG. 2 so that each tab will land on the face and be magnetically held thereto at a location in which the particular facial feature being thrown is usually located on a face. The person throwing the facial features on the face plate which most closely approach the face shown in FIG. 1 is adjudged the winner. This requires skill, and the fun of the game is derived when the contestants throw the facial features so that they land in unusual locations on the face.

In the modificaton of the invention shown in FIG. 4, the representation of the back of the package 10 is that of a spider web with elements representing bugs and spiders thereon. These elements are to be removed and thrown by the contestants at the spider web hoping they will land on the spider web in approximately the location shown in FIG. 4. Rarely, when thrown do they land that way, which adds to the humor or fun derived from the game.

The bug and spider elements are constructed in the same way as are the facial elements of the former modification, and likewise adhere magnetically to the back of the frame in the same manner.

I claim:

1. A game comprising a rectangular package having a frame, and a backing of magnetic susceptible material, an incomplete outline of an object on said backing within the frame, said package adapted to be suspended from a vertical surface, a plurality of magnetic tabs each simulating on one surface thereof a different feature of said object to complement the incomplete outline of said object, and tufts of hair extending from the margins of said surface outwardly to simulate the particular element of a tab, and acting as a stabilizer for the tab while being thrown at the target.

2. The game specified in claim 1 wherein the backing of the package includes a surface of ferrous material.

* * * * *